US007907100B2

(12) United States Patent
Mortazawi et al.

(10) Patent No.: US 7,907,100 B2
(45) Date of Patent: Mar. 15, 2011

(54) PHASED ARRAY ANTENNA WITH EXTENDED RESONANCE POWER DIVIDER/PHASE SHIFTER CIRCUIT

(75) Inventors: Amir Mortazawi, Ann Arbor, MI (US); Ali Tombak, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 329 days.

(21) Appl. No.: 10/558,150

(22) PCT Filed: May 21, 2004

(86) PCT No.: PCT/US2004/016008

§ 371 (c)(1),
(2), (4) Date: Nov. 21, 2005

(87) PCT Pub. No.: WO2004/107498

PCT Pub. Date: Dec. 9, 2004

(65) Prior Publication Data

US 2007/0091008 A1 Apr. 26, 2007

Related U.S. Application Data

(60) Provisional application No. 60/472,607, filed on May 22, 2003.

(51) Int. Cl.
*H01Q 3/36* (2006.01)
*H01P 1/18* (2006.01)

(52) U.S. Cl. ..... 343/853; 333/125; 333/136; 333/139; 333/164

(58) Field of Classification Search ..... 333/139, 333/156, 164, 125, 128, 136; 343/853
See application file for complete search history.

(56) References Cited

U.S. PATENT DOCUMENTS

| | | | | |
|---|---|---|---|---|
| 3,340,530 | A * | 9/1967 | Sullivan et. al. | 342/370 |
| 3,882,431 | A * | 5/1975 | Hopwood et al. | 333/139 |
| 5,014,023 | A * | 5/1991 | Mantele | 333/164 |
| 6,496,147 | B1 * | 12/2002 | Kirino | 343/700 MS |
| 2005/0270122 | A1 * | 12/2005 | Hyman et al. | 333/164 |

* cited by examiner

*Primary Examiner* — Benny Lee
(74) *Attorney, Agent, or Firm* — Young Basile

(57) ABSTRACT

A phased array for controlling a radiation pattern of an array of antennas includes a plurality of antenna ports, a first tunable element connected in series between each respective pair of adjacent antenna ports, and a second tunable element connected in parallel with each respective antenna port. The phased array provides progressive phase differences between successive antenna ports Equal amplitude of the signal can be maintained at each antenna. An equal amount of successive phase change can be provided in a signal at each antenna. A direct current source connectible to at least one input port can include an alternating power source through a matching circuit, such as a quarter-wave transformer The first and second tunable elements can be either an inductor or a capacitor, and/or can be in combination with transmission lines separating each respective antenna from a successive antenna by desired fraction of a wavelength.

9 Claims, 19 Drawing Sheets

PHASED ARRAY ANTENNA WITH EXTENDED RESONANCE POWER DIVIDER/PHASE SHIFTER CIRCUIT

CROSS-REFERENCE TO RELATED APPLICATIONS

This application claims the benefit of U.S. Provisional Patent Application Ser. No. 60/472,607 filed May 22, 2003, which is incorporated by reference herein in it's entirety.

FIELD OF THE INVENTION

The present invention relates to an extended resonance based phased array system for reducing and/or eliminating the need of a separate power splitter and phase shifters in a conventional phased array system, which results in a very compact and simple circuit structure at lower-cost.

BACKGROUND OF THE INVENTION

A phased array is a group of antennas in which the relative phases of the respective signals feeding the antennas are varied in such a way that the effective radiation pattern of the array is reinforced in a desired direction and suppressed in undesired directions. Phased arrays are extensively used in satellite communications, multipoint communications, radar systems, early warning and missile defense systems, etc., so they are employed in large quantities. The cost of phased arrays can range from US $150,000 (500 antennas) to US $1,000,000 (3000 antennas). In a conventional phased array system, the signal to be sent is divided into many branches using a power, splitter and each branch is then fed into a phase shifter (i.e. a phase shifter is a microwave component, which is used to delay the phase or timing of a sinusoidal signal) and followed by an antenna. The cost of a conventional phased array mainly depends on the cost of the phase shifters used. It has been estimated that almost half of the cost of a phased array is due to the cost of phase shifters. Because of the high cost of phase shifters, a significant amount of research has been performed to minimize the cost and improve the performance of phase shifters. In addition, conventional phased arrays result in very complex structures and suffer from high loss and mass.

SUMMARY OF THE INVENTION

In the present invention, a new phased array technique based on the extended resonance power dividing method is disclosed. The extended resonance is a power dividing combining technique, which results in a very compact circuit structure with high dividing/combining efficiency (>90%). This approach eliminates the need for separate power splitter and phase shifters in a conventional phased array system, resulting in significant amount of reduction in the circuit complexity and cost.

In the present invention, a novel technique is devised to design low-cost phased array systems. The present invention can reduce or eliminate the need for separate power splitter and phase shifters typically used in conventional phased array systems. Since the phasing and power splitting are performed simultaneously, the phased array cost is reduced substantially. Also, phased arrays based on this technique are compact and have simple circuit structures. It should be noted that the present technique has some performance limitations. The bandwidth of the phased arrays based on this technique is narrower than the bandwidth of conventional phased array systems. Also, the scanning range for the simplest design case is limited to approximately +/−22 degrees, whereas conventional systems can go up to +/−60 degrees. The scanning range according to the present invention can be increased by cascading two or more phased arrays of this design.

A phased array is a group of antennas in which the relative phases of the respective signals feeding the antennas are varied electronically in such a way that the effective radiation pattern of the array is reinforced in a desired direction and suppressed in undesired directions. Phased arrays are the ideal solution for many applications, such as early warning and missile defense systems, satellite communications, traffic control systems, automotive collision avoidance and cruise control systems, blind spot indicators, compact scanning arrays, smart base station antennas for cellular communications, etc. In a conventional phased array, the signal is divided into many branches using a corporate feed network and each branch is then fed into a phase shifter and followed by an antenna. Phase shifters are considered as the most sensitive and expensive part of a phased array. Also, the complexities in the corporate feed network, the bias network for the phase shifters, and the interactions between array elements, can make the design of phased arrays very challenging and expensive. Therefore, the phased arrays have been used only in a few sophisticated military applications and space systems. These applications usually have stringent requirements on the side lobe levels, scan range and beam width of the phased arrays. On the other hand, phased arrays are being considered for emerging commercial applications, such as automotive collision avoidance systems, mobile multimedia broadcasting, and traffic control radars. In these systems, accurate beam control and wide scan angle are not required. Instead, low cost, small size, and ease of manufacturability are the driving criteria.

The extended resonance is a power dividing/combining technique, which results in a very compact circuit structure with high dividing/combining efficiency (>90%). This approach eliminates the need for separate power splitter and phase shifters in a conventional phased array system, resulting in significant amount of reduction in the circuit complexity and cost. In the present invention, an improved extended resonance phased array topology is disclosed. It simplifies the design of large arrays and allows circuit miniaturization and integration capability for phased arrays. The fabrication and measurement results for an X-band 8-antenna phased array is disclosed as an example of this topology.

The present invention can provide dramatic cost reductions in the cost of phased array antenna systems. As discussed earlier, phased arrays based on this technique do not need separate power splitter and phase shifters. The phased arrays according to the present invention simply use varactors (i.e. devices whose capacitance can be varied with an applied DC voltage) for splitting the power and achieving the required phase shift.

As mentioned earlier, phased arrays based on the technique of the present invention use tunable capacitors, or varactors. Varactors can be fabricated based on solid-state, MEMS, and ferroelectric technologies. The solid-state based varactors are well-mature and can easily be obtained commercially, whereas the MEMS and ferroelectric based varactors are still under development.

Phased arrays have been finding increasing number of applications in military and commercial communication systems. The phased array system can steer a beam rapidly by electronically tuning the relative phase between the antennas compared to mechanical beam-steering. Conventional phased array use a phase shifter for each antenna element.

However, the cost of the phased array increases significantly with the number of phase shifters used. These systems are also very complex, bulky and heavy. Cost reduction and performance improvement is necessary in phased arrays to address the emerging commercial applications, such as smart antennas, automotive collision avoidance and cruise control systems.

The present invention describes a power divider/phase shifter (PDPS) circuit that distributes radio frequency (RF)/microwave power injected into an input port among several output ports (the output signal amplitudes can be the same or different depending on the design requirements) while providing a variable phase shift across the output ports. Variable phase shift is achieved by incorporating tunable reactive elements (capacitors or inductors) in the circuit.

Tunable capacitors can be based on varactor diodes, ferroelectric tunable capacitors, MEMS tunable capacitors or adjustable length of transmission lines using various switches like PIN diodes, transistors, mechanical or MEMS switches.

Tunable inductors can be based on ferrite devices or active inductors (using transistors to emulate inductors). Some of the applications of the PDPS circuits include: (1) Low cost one and two dimensional phased array antennas; (2) Tunable transversal active filters; and (3) Tunable transversal equalizers.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
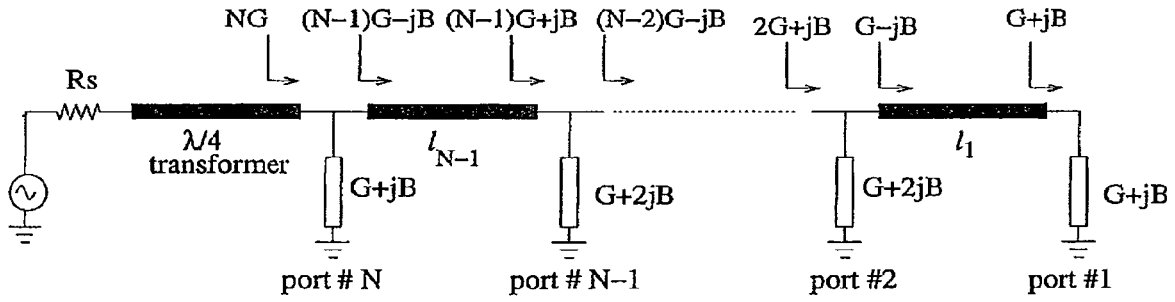
FIG. 1 illustrates an extended resonance concept incorporating N-ports according to one embodiment of the invention.
Figure 2:
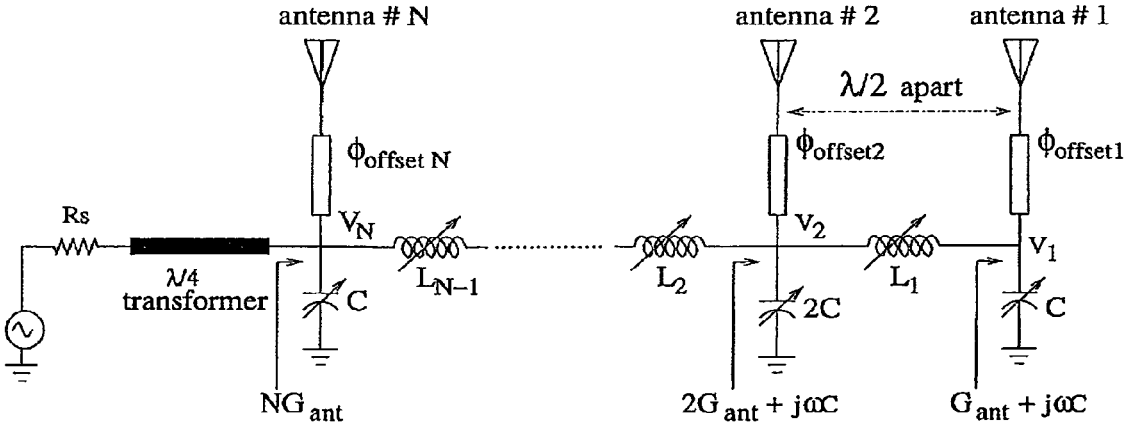
FIG. 2 illustrates the extended resonance based phased array system according to the present invention.

The present invention uses extended resonance which is a power dividing/combining technique, which has been exploited for the design of power amplifiers at microwave and millimeter wave frequencies. It results in very compact structures with high dividing/combining efficiency (>90%) up to millimeter wave frequencies. An N-port extended resonance dividing circuit is shown in FIG. 1. The admittance of the first and the last port is G+jB (where G is conductance and B is susceptance), whereas the admittance of the each interior port is G+2jB. The length of the transmission line, $l_1$, is chosen such that the admittance of the first port is transformed to its conjugate, G−jB. The admittance at the plane of the second port will be 2G+jB. As can be seen, half of the susceptance of the second device is cancelled in this process. The length of the next transmission line $l_2$ for port #2 is chosen to transform 2G+jB to its conjugate, 2G−jB. This process is performed (N−1) times. At the last stage, the admittance at the plane of the $(N-1)^{th}$ transmission line, $l_{N-1}$, will be (N−1)G−jB transformed to its conjugate $(N-1)G_{+j}B$ and the admittance at the plane of the $N^{th}$ port will be NG, which is matched to the source impedance Rs using a quarter-wave transformer, $\lambda/4$. Resonating all the ports with one another essentially places the ports in shunt, and analysis of this structure shows that the voltage at each port is equal in magnitude, but generally not in phase. This feature has been exploited for the design of power amplifiers at microwave and millimeter wave frequencies. It can be shown that by correct selection of susceptance B and conductance G, one can maintain equal power division, and vary the relative phase shift between device nodes by changing susceptance B. It should also be mentioned that it is possible to design an extended resonance dividing circuit for arbitrary imaginary part of the port admittances as long as the admittances are transformed to their conjugates and the last stage is matched to the source impedance Rs The concept of a phased array based on the extended resonance technique can be explained as follows: The port in FIG. 1 compared to FIG. 2 is modeled as a shunt combination of an antenna ($G=G_{ant}$) and a capacitor ($B=\omega C$). An inductor, $L_1$, $L_2$. $L_{n-1}$ in FIG. 2, is used to transform the admittance to its conjugate instead of a transmission line, generally illustrated by $l_1$, etc. as used in FIG. 1. A schematic illustration of the proposed phased array is shown in FIG. 2. The antennas are assumed to be λ/2 apart, and the capacitors C and 2C and inductors, $L_1$, $L_2$. $L_{n-1}$ etc., are assumed to be tunable. It can be shown that the required inductance to transform the admittance, i.e. $2G_{ant}+j\omega C$ to its conjugate, $2G_{ant}-j\omega C$ is:

$$L_n = \frac{2C}{(nG_{ant})^2 + (\omega C)^2} \tag{1}$$

Using the inductor value found in (1), the ratio of the voltages between successive antenna nodes is calculated to be:

$$\frac{V_n}{V_{n-1}} = \frac{((n-1)G_{ant} + j\omega C)^2}{((n-1)G_{ant})^2 + (\omega C)^2} \tag{2}$$

Therefore, the phase shift between successive antenna nodes will be:

$$\theta_{n,n-1} = \tan^{-1}\left\{\frac{2(n-1)G_{ant}\omega C}{((n-1)G_{ant})^2 - (\omega C)^2}\right\} \tag{3}$$

Figure 3:
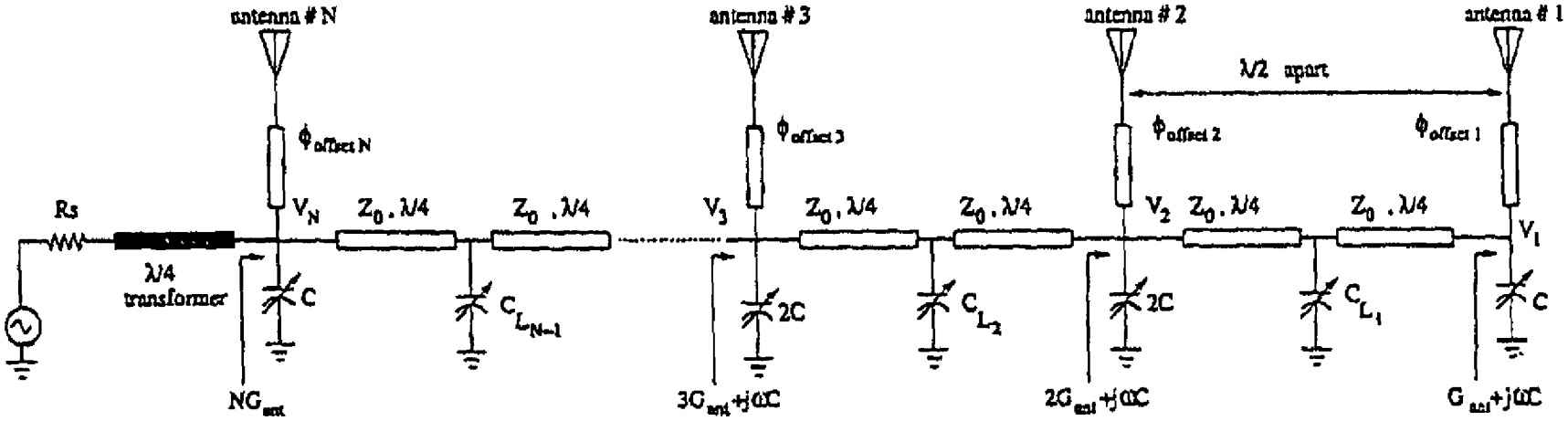
FIG. 3 illustrates the practically realizable extended resonance based phased array according to the present invention.
Figure 4:
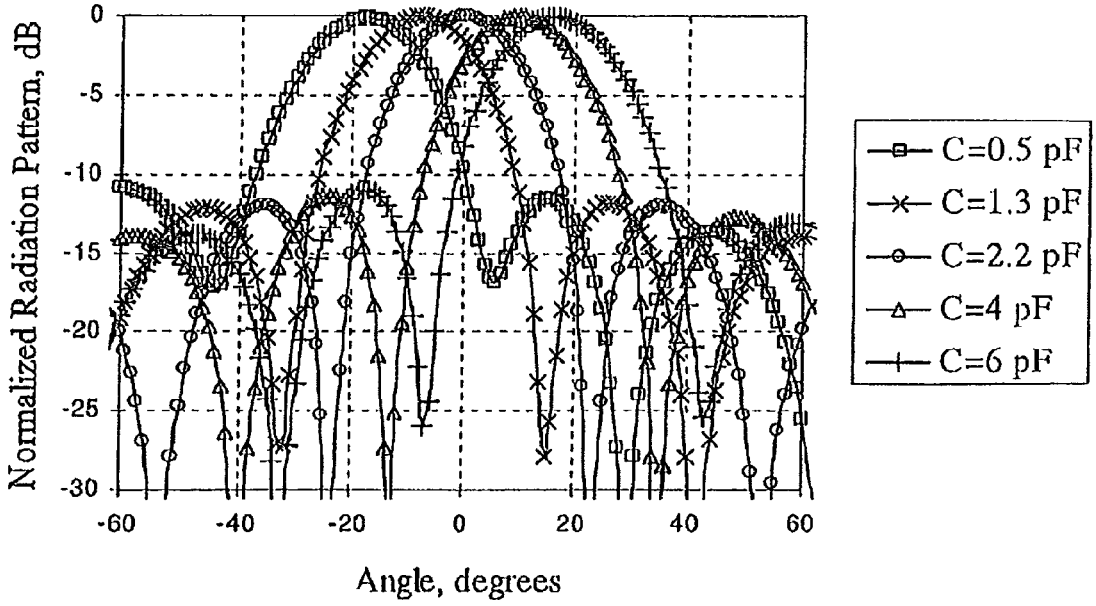
FIG. 4 illustrates a simulated scanning for a five antenna extended resonance phased array at 2 GHz with no loss is included.

It can be concluded from equation (3) that changing the capacitance at each port will result in a change in the phase difference between the successive antenna ports. In a phased array, the phase shifts between successive antenna ports must be equal to each other ($\theta_{21}=\theta_{32}=\theta_{43}\ldots$). Depending on the number of antennas, N, and the tunability of the capacitor, there exists an optimum capacitive susceptance, which results in the same phase shift between the successive antenna nodes while dividing the power equally. Therefore, a phased array system with one dimensional scanning capability can be built. Since realizing tunable inductors is not very easy and the antennas have to be spaced approximately λ/2 apart depending on the design, the circuit of FIG. 2 may not be practical. Instead, artificial tunable inductors can be realized using an impedance inverter consisting of two quarter-wave transformers $z_0$, 214 with a shunt tunable capacitor $C_L$ in between. Phase offsets must be introduced prior to the antennas to make the absolute phases of the voltages at, the antenna ports equal to each other. The proposed extended resonance based phased array system is shown in FIG. 3. Based on the theory outlined, the simulated normalized radiation pattern for a five antenna extended resonance based phased array at 2 GHz for various capacitor values, C, is shown in FIG. 4. This graph shows the antenna radiation pattern (beam) scanning as a function of varactors' capacitance being tuned in the extended resonance phased array. In this simulation, no loss from the tunable capacitors or transmission lines is included.

Figure 5:
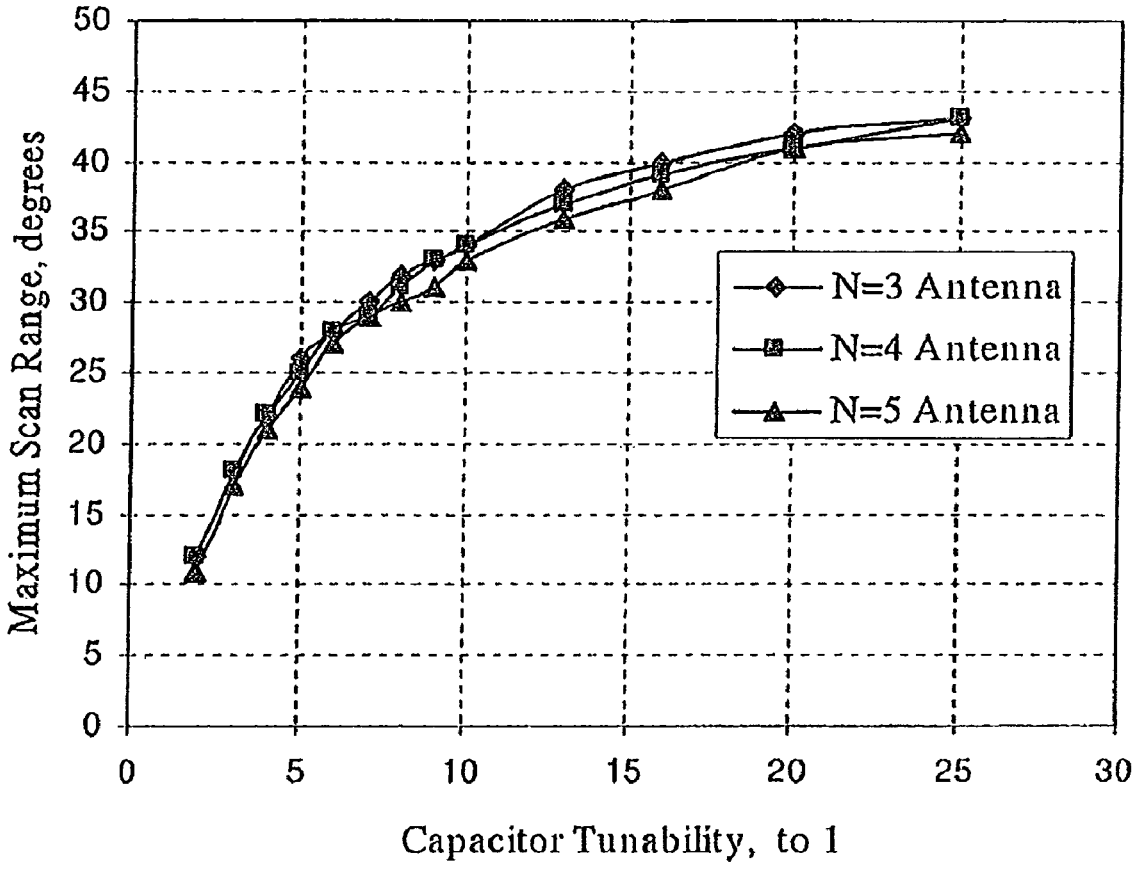
FIG. 5 illustrates a maximum scan range versus capacitor tunability according to the present invention.
Figure 6:
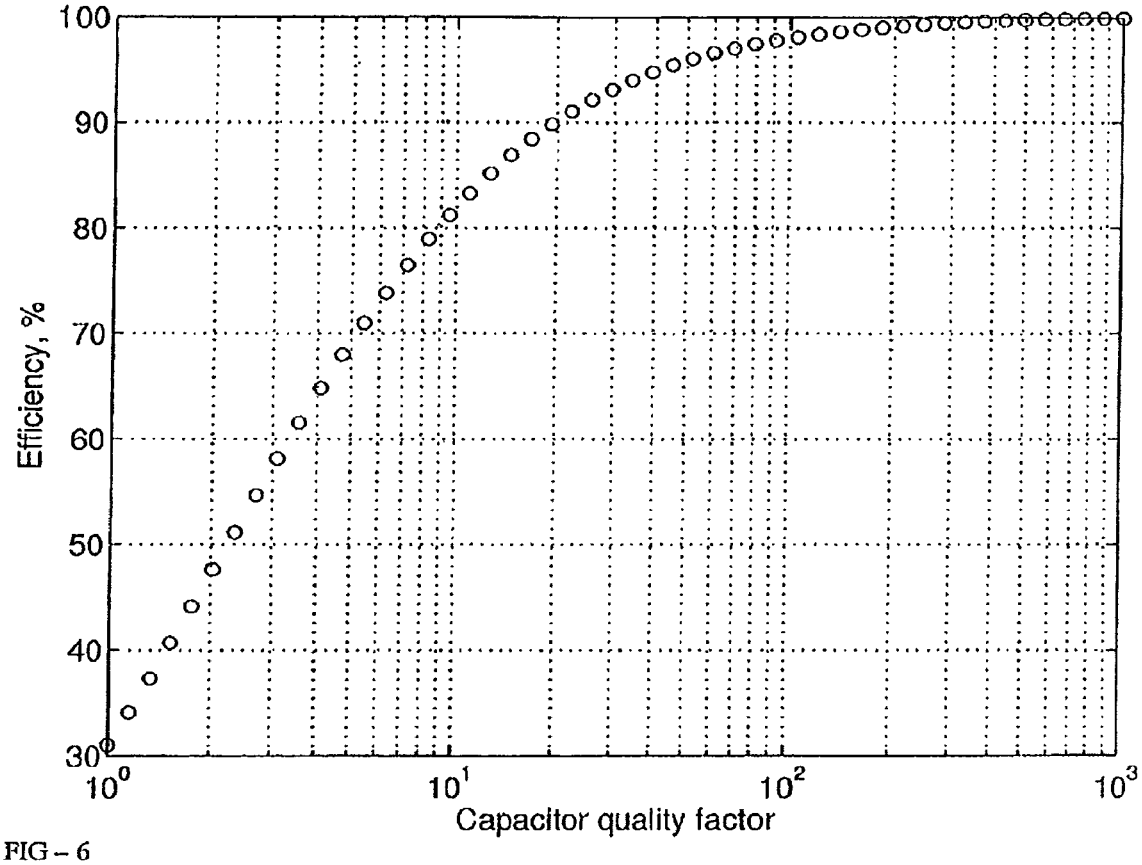
FIG. 6 illustrates an effect of a capacitor quality factor on the array efficiency according to the present invention.

The simulated maximum scanning range for various array sizes as a function of the capacitor tunability is plotted in FIG. 5. This graph shows the calculated array scan range (the extend of the radiation beam rotation) for an extended resonance array containing 3, 4 and 5 antennas versus the varactors; tunability. This signifies that as one increases the size of the array, one can maintain the scan range. It can be concluded that for this particular design, the maximum achievable scan range is approximately 44 degrees. The effect of the capacitor quality factor on the array efficiency is also shown in FIG. 6. It turns out that with a moderate capacitor quality factor (Q=~10), it is possible to obtain higher than 80% efficiency. This graph shows the array efficiency (the ratio of the radiated rf power over the input power to the array) as a function of the varactors' (tunable capacitor) quality factor (which signifies the losses within the varactors). Extended resonance based phased arrays can reduce and/or eliminate the need for a separate power splitter and phase shifters in a conventional phased array system, which results in a compact, simple and low-cost circuit architecture.

Example 1

Figure 7:
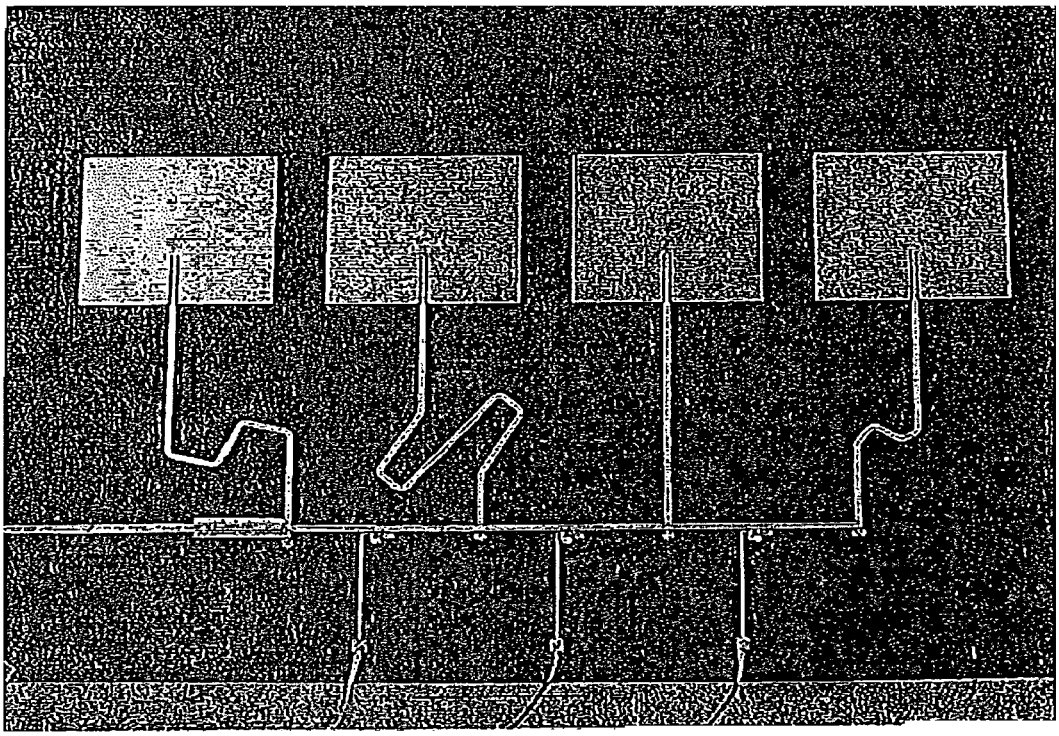
FIG. 7 is a photo of a phased array according to Example 1 of the present invention.
Figure 8:
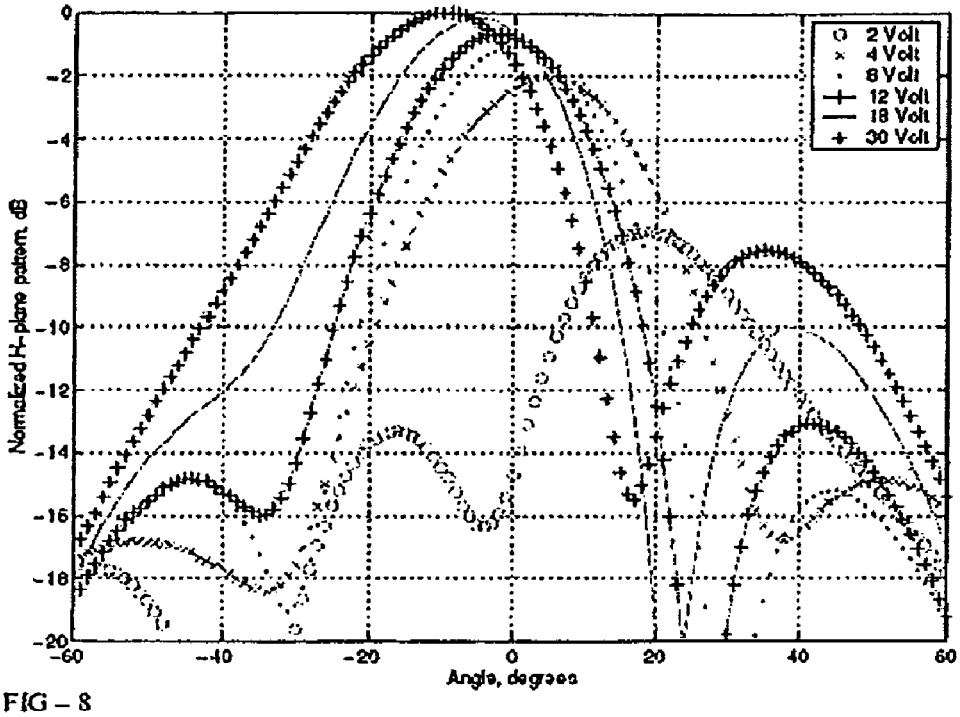
FIG. 8 illustrates a measured H-plane pattern for various diode voltages according to Example 1 of the present invention.

To demonstrate the operation of this technique, a two GHz extended resonance based phased array including four edge coupled microstrip patch antennas placed half wavelength apart was designed, fabricated and tested. A 31 mil thick RT/DUROID™ 5880 high frequency laminate substrate from Rogers Corporation was used to build the phased array. MSV34 series chip varactor diodes from Metelics Inc. were used as tunable capacitors. A photo of the phased array can be seen in FIG. 7. The overall size of the phased array was 39×25 $cm^2$. The measured H-plane pattern of the phased array for various diode voltages is shown in FIG. 8 and the measured performance is summarized in Table 1. The graph shows the measured radiation pattern as a function of the bias voltage applied to the varactor diodes for the array shown in FIG. 7. The results show that the phased array can scan the beam +/−13.5 degrees with the application of 2 V to 30 V reverse bias to the varactor diodes. The side lobe level was better than 7 dB. The gain of the phased array was measured to be 8.3 dB at 30 V reverse bias applied to the varactors. It can be seen from FIG. 8 that the gain at 2 V is 6.9 dB lower than the gain at 30 V. This is due to the low quality factor of the varactor diodes at this voltage ($Q_{2V}$=22, $Q_{30V}$=121 at 2 GHz), resulting in significant amount of RF power dissipation within the diode and change in the input impedance, which degrades the return loss. It should be noted that any type of tunable capacitors, such as ferroelectric or MEMS based tunable capacitors, switched capacitors using PIN diodes or MEMS switches, which have been known to have lower loss, can be used to fabricate the phased array. In extended resonance based phased arrays, fewer numbers of devices are employed compared to a conventional phased array system, thereby reducing the cost.

TABLE 1

The measured performance of the phased array.

| Diode Voltage (V) | Scan Angle (degrees) | Beamwidth (3 dB), deg. | Side Lobe Level (dB) |
|---|---|---|---|
| 2 | 18 | 26 | −7 |
| 4 | 5 | 28 | −13 |
| 8 | 0 | 26 | −14 |
| 12 | −2 | 25 | −13 |
| 18 | −5 | 26 | −10 |
| 24 | −8 | 27 | −9 |
| 30 | 9 | 29 | −7.5 |

An extended resonance based phased array according to the present invention eliminates the need for a separate power splitter and phase shifters in a conventional phased array system. Since the phasing and power division is performed simultaneously at the same stage, this phased array needs fewer number of devices compared to a conventional phased array system, thereby reducing the cost substantially. As a proof of principle, a 2 GHz extended resonance based phased array consisting of 4 microstrip patch antennas was designed, fabricated and tested. The measured scan range was +/−13.5 degrees with an average beamwidth of 26 degrees.

The concept of extended resonance based phased arrays is shown in FIG. 2. The concept uses tunable capacitors C and 2C and tunable inductors $L_1$, $L_2$, $Ln_{-1}$ etc. The admittance seen at the plane of the 1st port ($G_{ant}$+jωC) is transformed, to its conjugate using the 1st inductor ($L_1$). Similarly, the admittance at the 2nd port ($2G_{ant}$+2jωC) is transformed to its conjugate using the 2nd inductor ($L_2$). This process is performed (N−1) times, and the admittance seen at the plane of the last port will be $NG_{ant}$, which is matched to the source impedance using a matching network. The analysis of this structure shows that the voltages at each port are equal in magnitude (equal power division among antennas), and the phase difference between adjacent ports are all equal to each other. Therefore, by tuning the varactors as well as inductors, one can obtain equal power division among antennas and phase shifting between successive ports. Thus, a phased array system with one-dimensional scanning capability can be designed. Due to the initial phase offsets between the power divider ports, constant phase delays ($\Phi_{offset1}$, $\Phi_{offset2}$, . . . $\Phi_{offsetN}$) are used as shown in FIG. 2 to set the initial phases at the antenna nodes equal to each other. From then on, the beam is steered around the boreside of the antennas by tuning the varactors. It should also be noted that an extended resonance circuit can be designed for a specified amplitude taper to achieve low side lobe. Since the magnitude of the voltage V is always the same as long as the admittances seen at the ports are transformed to their conjugates, non-uniform amplitude distribution can be obtained by adjusting the conductances seen at the ports (or antenna input impedances). In some designs unequal power distribution is desirable, for example arrays using Chebyshev tapered distribution for lower side lobes. The design according to the present invention can accommodate this.

Tunable inductors were previously realized using impedance inverters consisting of two quarter-wave transformers $z_0$, λ/4 with a shunt varactor $C_L$ in between, as shown in FIG. 3. However, this approach has a bandwidth limitation due to the quarter-wave transformers used. Furthermore, the structure of FIG. 2 requires the value of the tunable capacitors C to increase progressively as odd multiple of the first varactor capacitance and the value of the tunable inductors L to decrease progressively compared to the first inductor. This can place a limit on the design of varactors and possible capacitance values available. In this section, the design methodology of an extended resonance based phased array, which uses fixed inductors and single value varactors is presented.

The required inductance to transform the admittance, $nG_{ant}$+njωC, to its complex conjugate, $nG_{ant}$−njωC, is:

$$L_n = \frac{2C}{nG_{ant}^2 + n\omega^2 C^2} \tag{4}$$

Using equation 4 (and assuming $\omega C_{max}=G_{ant}\sqrt{t}$ for maximum phase shift), the required tunability for the tunable inductors is calculated as:

$$t_L = \frac{1+t}{2\sqrt{t}} \tag{5}$$

where t is the tunability of the varactor (the ratio of the maximum capacitance to the minimum capacitance, $t=C_{max}/C_{min}$). The required tunability for the inductors increases as the tunability of the varactors increase, but not at the same rate. For example, $t_L$=1.34 for a varactor with t=5 and $t_L$=1.74 for a varactor with t=10. Since not much tunability is required for the inductors, in this design, the value of the inductor is kept constant at an average value between its maximum and minimum values at the expense of tolerating some small power division and phase errors. Consider a generalized extended resonance phased array circuit in FIG. 2. $P_1$, $P_2$, . . . $P_N$ designate the required powers going into the antennas to achieve a specified amplitude taper. Since the magnitude of the voltage between power divider ports are equal to each other, the conductances seen at the power divider ports (or input conductances of the antennas) are designed to achieve the required power ratios. For example, the 2nd conductance will be $$G_2=G_1P_2/P_1 \tag{6}$$

The matching networks are used to transform the real admittances seen at the plane of the antennas to $G_1$. Therefore, only a single varactor value is used throughout the whole design. It also helps the realization of larger phased arrays based on this technique. Similarly, the 3rd conductance is designed such that the required power is divided between the 3rd antenna and all the other antennas before the 3rd antenna. Therefore, the 3rd conductance will be $$G_3=G_1P_3/(P_1+P_2) \tag{7}$$

Similarly, this process is performed N−1 times, and at the last stage, the real admittance is matched to the source impedance using a matching network. Since amplitude coefficients for a phased array are usually symmetric, the structure of FIG. 2 is further modified as shown in FIG. 3. Half of the phased array can be designed for the desired amplitude coefficients, and two of these phased arrays are connected using an extended resonance network. This structure will have several advantages over the structure in FIG. 2, such as reduced frequency scanning due to its symmetry, and physically realizable matching networks. The left and right portions, with respect to a common combined input line corresponding to a line of symmetry joining the two phased arrays (not shown), of the phased arrays must be isolated while biasing the varactors. The varactors on the left portion and the right portion must be biased such that the same progressive phase shift is obtained between successive ports compared to the phase shift when the phased array scans the boreside. Based on the theory outlined; simulated array factor for an X-band 8-antenna phased array is shown in FIG. 4. In this simulation, the varactor quality factor is assumed to be 15 at 10 GHz, and inductors are kept constant. The phased array can steer the beam 31 degrees by tuning the varactors between 0.9 pF and 0.159 pF. The side lobe levels are better than 15 dB. This degradation compared to the designed side lobe level of 20 dB is due to utilization of the fixed inductors.

Example 2

Figure 9:
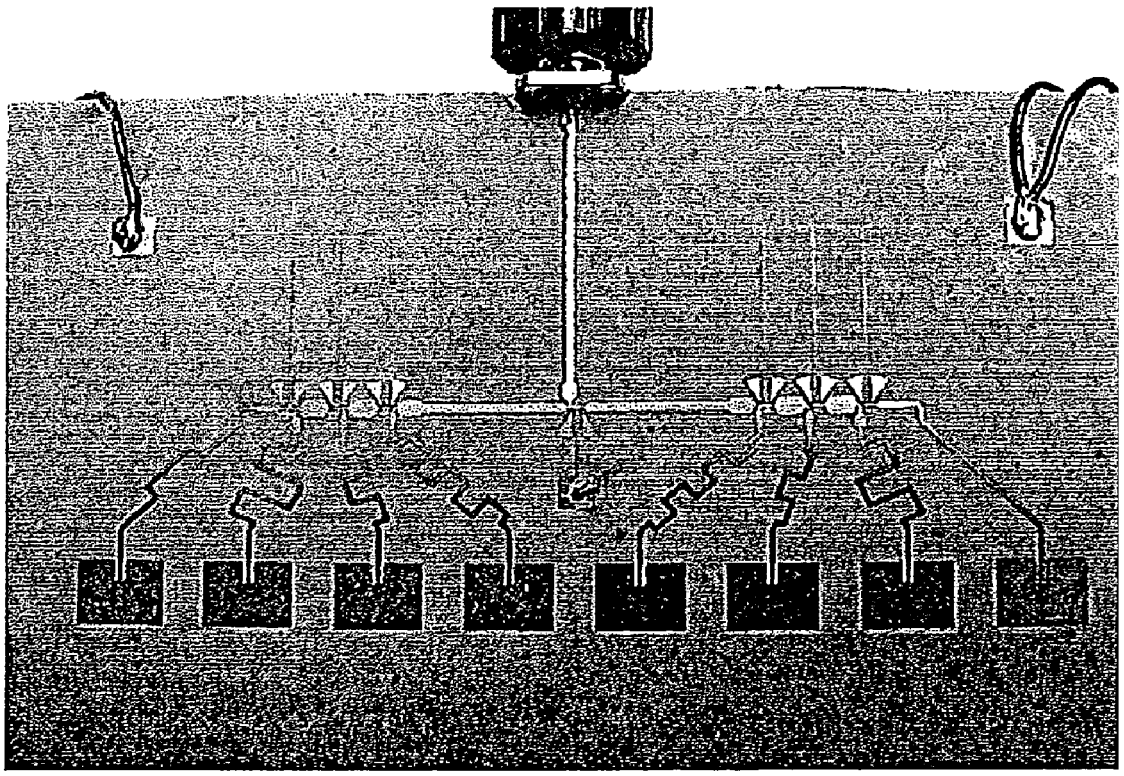
FIG. 9 is a photo of the phased array according to Example 2 of the present invention.
Figure 10:
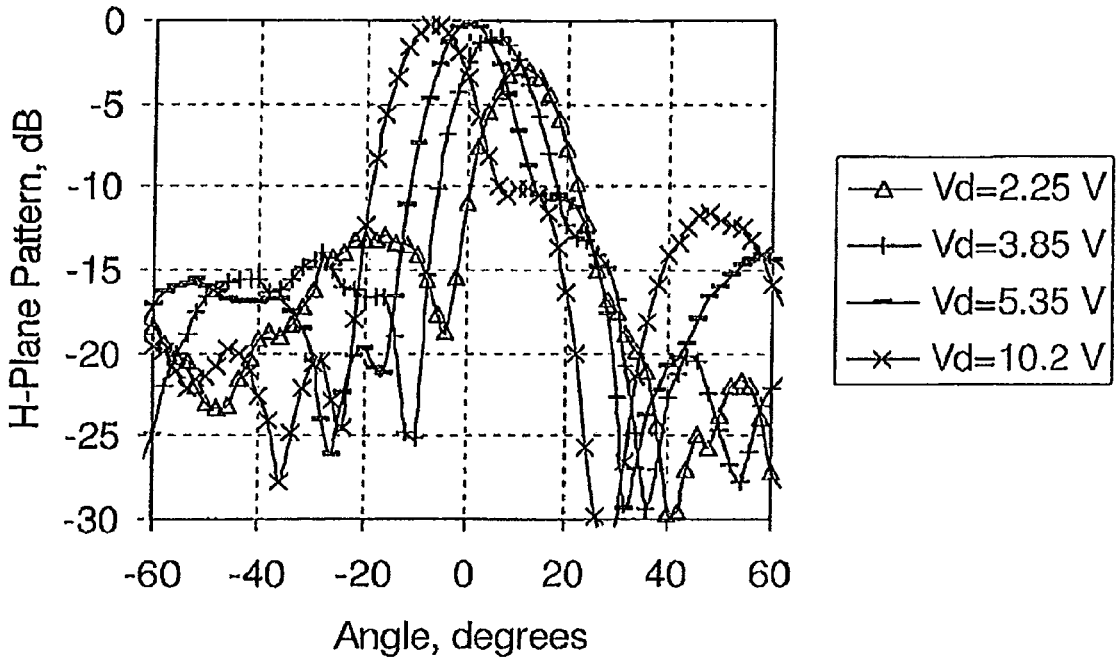
FIG. 10 illustrates a measured H-plane pattern for various diode voltages according to Example 2 of the present invention.

A 10 GHz extended resonance based phased array including 8 microstrip patch antennas has been designed, fabricated and tested. The antennas were half wavelength apart A 15 mil thick TMM3™ substrate from Rogers Corporation was used to build the phased array. MA46580 series beam lead varactor diodes from MACOM Inc. were used as tunable capacitors. A photo of the phased array is shown in FIG. 9. The overall size of the phased array was 11.4×3 $cm^2$ (except for the bias lines and input feed line). The measured H-plane radiation pattern angle as a function of the bias voltage applied to the varactor diodes of the phased array shown in FIG. 9 is shown for various diode voltages in FIG. 10. The preliminary measurement results show that the phased array can steer the beam 18 degrees with the application of 2.25 V to 10.2 V reverse bias to the varactor diodes. The measured side lobe level was better than 10 dB. It can be seen from FIG. 10 that the gain of the phased array decreases as the diode voltage is reduced to 2.25 V. This is due to the low quality factor of the varactor diodes at this voltage, resulting in significant amount of RF power dissipation within the diode and change in the input impedance, which degrades the return loss. In extended resonance based phased arrays, fewer number of devices are employed compared to a conventional phased array system, thereby reducing the cost. The circuit topology presented here also simplifies the design of large phased arrays while having a compact circuit area for dividing the power and phase shifting.

Phased arrays based on extended resonance power dividing technique do not need a separate power splitter and phase shifters compared to conventional systems. This results in a substantial reduction in the phased array cost and circuit complexity. A new circuit topology has been introduced, which simplifies the design of large phased arrays while having a compact circuit area for power division and phase shifting. An X-band 8-antenna phased array based on this technique has been designed, fabricated and tested. The measured scan range was 18 degrees, and the side lobe level was better than 10 dB.

Figure 11:
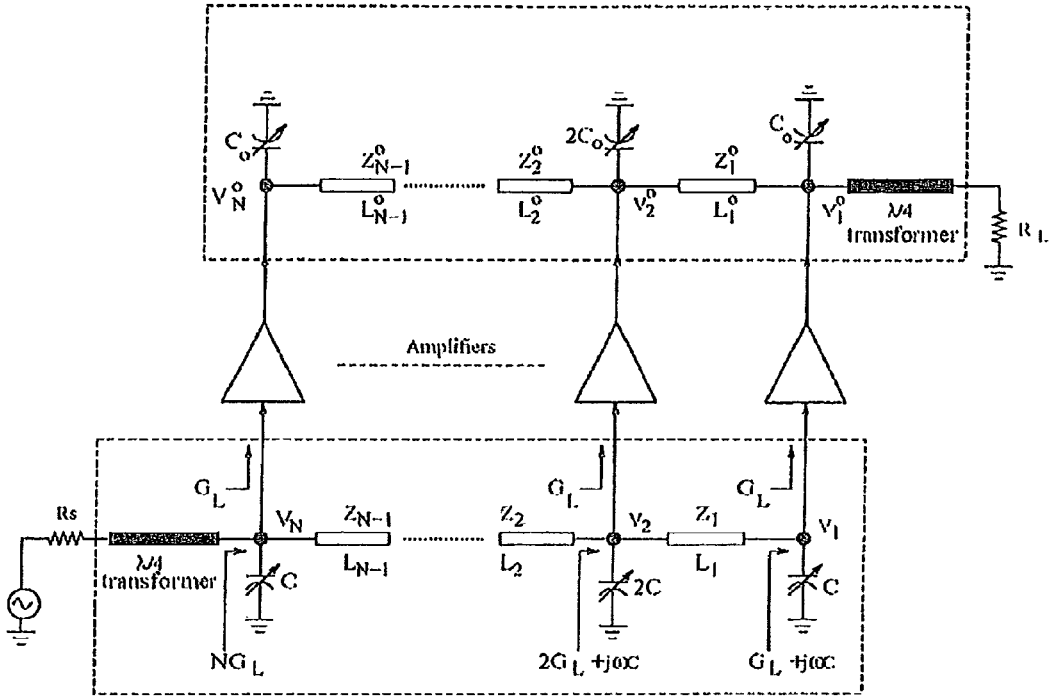
FIG. 11 illustrates an active transversal filter using a power divider/phase shifter (PDPS) circuit according to the present invention.
Figure 12:
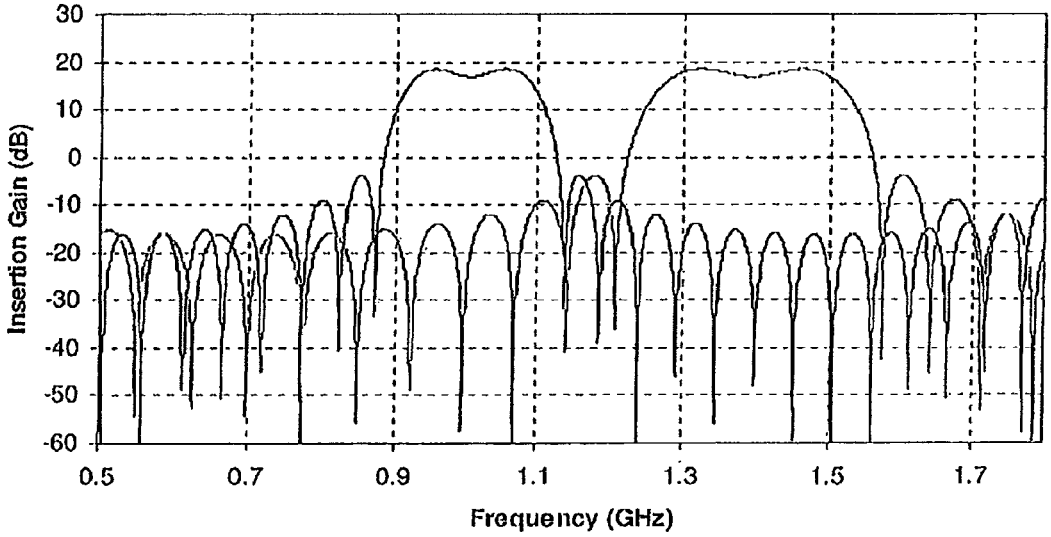
FIG. 12 illustrates a simulated response of a PDPS based tunable transversal filter with a frequency tunability of 400 MHz.

Tunable transversal active filter design using a power divider/phase shifter (PDPS) circuit according to the present invention is illustrated in FIG. 11. It can be seen that FIG. 11 shows one possible circuit configuration incorporating two PDPS circuits connected in tandem via several amplifiers. Use of amplifiers here is not essential for the operation of such circuit; however the amplifiers simplify the circuit design and provide gain. By correct design of signal phase and amplitude distribution across the circuit, a bandpass filter response can be synthesized. FIG. 12 shows the simulated results for an active transversal filter based on a PDPS circuit topology operating around a center frequency of 1 GHz. This graph shows the tunable active filter response gain as the varactors' capacitances are varied based on the application of the bias voltage, with the two large lobes showing the center frequency response and the filter passband at two different bias voltages. Adaptive transversal equalizers are common in the design of digital communication systems (wireless and optical fiber based) can be design using the new PDPS circuit. The adaptive transversal equalizers look similar to the transversal filter circuit of FIG. 11; however, the adaptive transversal equalizers have different design requirements. The PDPS circuit can be either fabricated in hybrid form or in chip form using integrated circuit (IC) fabrication techniques. In this case, a small chip can be mass produced. The PDPS chip can have an input port and several output ports and biasing port(s). The PDPS chip can be employed for the design of a phase array antenna or tunable filter or other applications.

Figure 13:
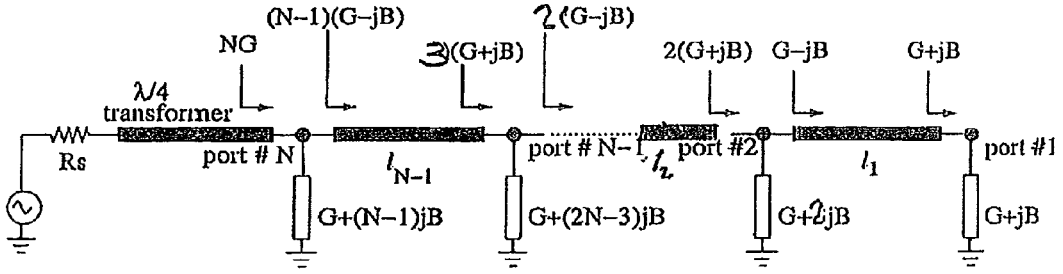
FIG. 13 illustrates an extended resonance concept incorporating N-ports according to the present invention.

A modified approach with improved performance is disclosed in the present invention. An N-port extended resonance power divider circuit is shown in FIG. 13. The admittance connected to the n port for n<N is G+2(n−1)jB, whereas the admittance connected to the last port is G+(N−1)jB. The length of the first transmission line, $l_1$, is chosen such that the admittance at the first port is transformed to its conjugate, G−jB. The admittance seen at the second port is 2(G+jB). Similarly, the length of the next transmission line $l_2$( ), is chosen to transform 2(G+jB) to its conjugate, 2(G−jB) i. This process is performed (N−1) times, and at the last stage, the admittance seen at the plane of the $(N-1)^{th}$ transmission line will be (N−1)(G−jB) and the admittance seen at the $N^{th}$ port will be NG, which is matched to the source impedance using a quarter-wave transformer. The analysis of this structure shows that the voltages at each port are equal in magnitude (equal power division), but not in phase. This feature has been exploited for the design of power amplifiers at microwave and millimeter wave frequencies.

Figure 14:
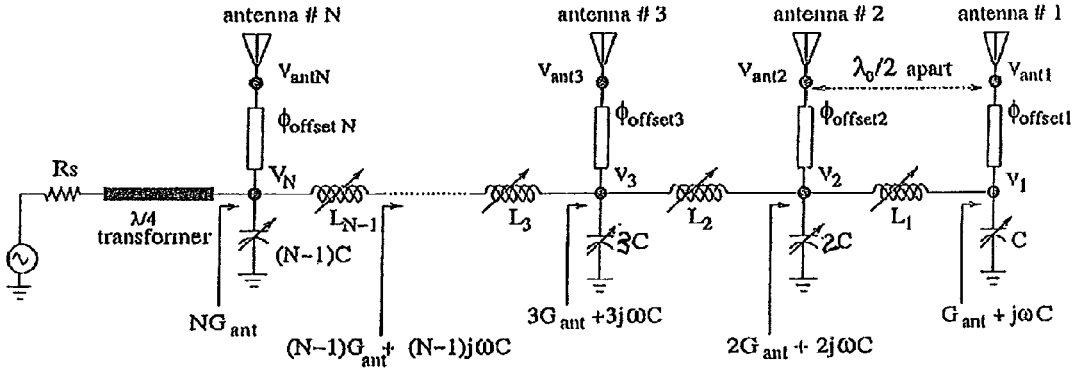
FIG. 14 illustrates the extended resonance based phased array concept according to the present invention.

The concept of a phased array based on the extended resonance technique is depicted in FIG. 14. The power divider ports are connected to an antenna ($G=G_{ant}$) in shunt with a tunable capacitor (varactor) ($B=\omega C$). Instead of a transmission line l, a tunable inductor L is used to transform the admittance to its complex conjugate as the shunt varactors are tuned. The required inductance to transform the admittance, $nG_{ant}+n\omega C$, to its complex conjugate, $nG_{ant}-n\omega C$, is:

$$L_n = \frac{2C}{nG_{ant}^2 n\omega^2 C^2} \tag{8}$$

Using the inductor value found in equation (8), the ratio of the voltages between successive ports is:

$$\frac{V_{n+1}}{V_n} = \frac{(G_{ant} + j\omega C)^2}{G_{ant}^2 + \omega^2 C^2} \tag{9}$$

Therefore, the magnitude of the voltage ratio is $$\left|\frac{V_{n+1}}{V_n}\right| = 1 \tag{10}$$

and the phase difference between successive ports is $$\angle\frac{V_{n+1}}{V_n} = \theta_{n+1,n} = \tan^{-1}\left\{\frac{2\omega C G_{ant}}{G_{ant}^2 - \omega^2 C^2}\right\} \tag{11}$$

Equation (11) can be further simplified as:

$$\theta_{n+1,n} = 2\tan^{-1}\left\{\frac{\omega C}{G_{ant}}\right\} \tag{12}$$

Figure 15:
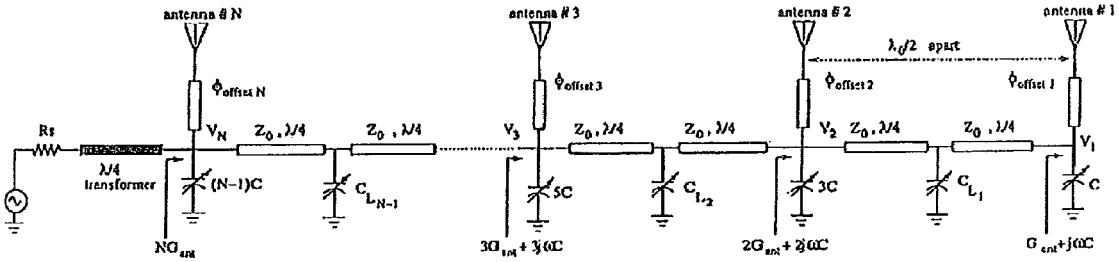
FIG. 15 illustrates a more realizable extended resonance based phased array according to the present invention.

Note that the phase differences between successive power divider ports given by equation (12) are all equal to each other regardless of the port number in the circuit. It should be mentioned that in a uniform amplitude phased array, the amplitude of the signal at the antennas must be the same and the phase of the signal at each antenna must successively change by the same amount. Therefore, by tuning the varactors as well as inductors given by equation (8), one can obtain equal power division among antennas as given in equation (10) and the same phase shift between successive power divider ports as given in equation (12). Thus, a phased array system with one-dimensional scanning capability can be designed. It should also be noted that an extended resonance circuit can be designed for arbitrary real and imaginary parts of the port admittances as long as the admittances seen at the ports are transformed to their conjugates. In that case, the magnitude of the voltage at each port will be equal to each other and non-uniform power distribution among antennas will be obtained to achieve low side lobe. Due to the initial phase offsets between the power divider ports, constant phase delays ($\Phi_{offset1}, \Phi_{offset2} \ldots \Phi_{offsetN}$) are used as shown in FIG. 14 to set the initial phases at the antenna nodes equal to each other. From then on, the beam is steered around the boreside of the antennas by tuning the varactors. Since realizing tunable inductors is not easy, the circuit of FIG. 14 can be further modified. Artificial tunable inductors can be realized using an impedance inverter consisting of two quarter-wave transformers λ/4 with a shunt varactor $C_L$ in between. This will both ease the realization of the tunable inductors and provide approximately λ/2 spacing for the antennas. A more realizable extended resonance based phased array circuit is shown in FIG. 15.

Figure 16:
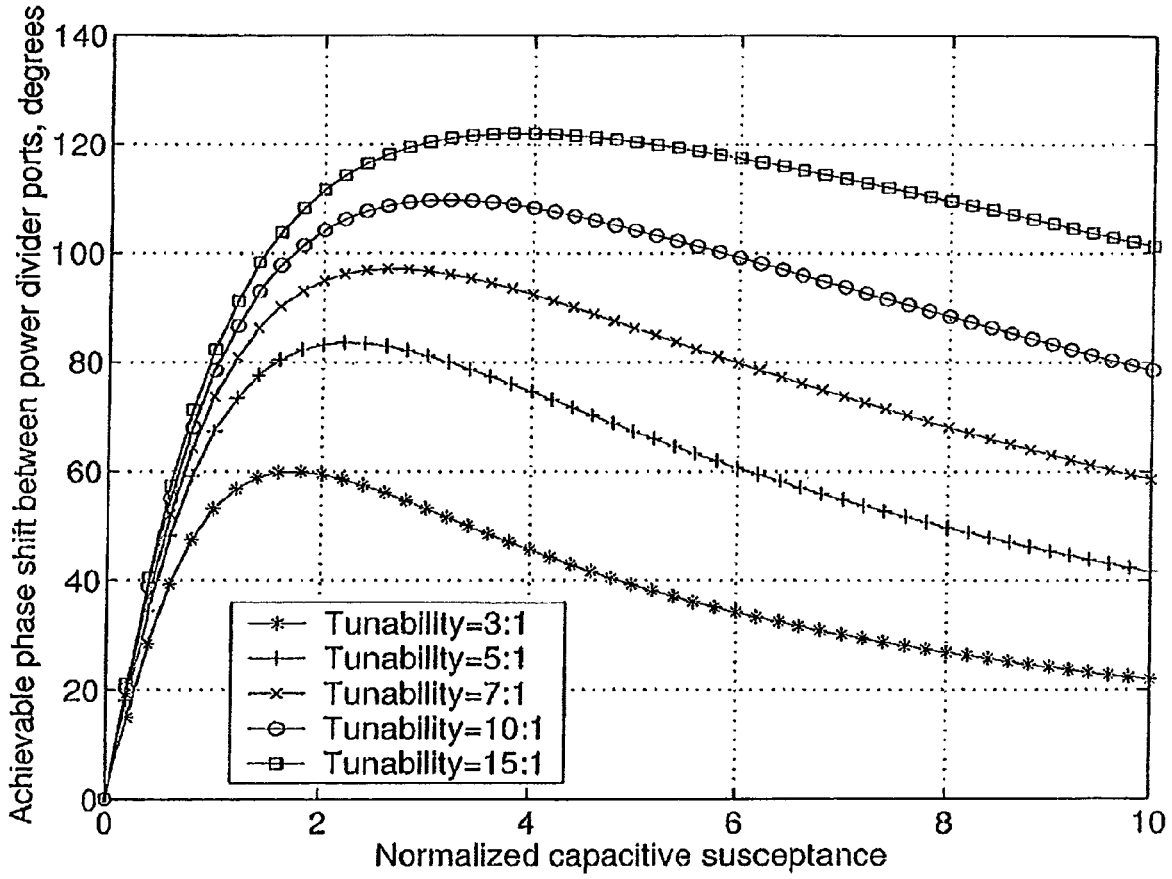
FIG. 16 illustrates the achievable phase shift between successive power divider ports for various varactor tunabilities according to the present invention.

The maximum achievable phase shift for a given varactor tunability is studied next. The achievable phase shift between power divider ports when the varactors are tuned is:

$$\Delta\theta = \theta_{n+1,n}(C) - \theta_{n+1,n}(C/t) = 2\tan^{-1}\left\{\frac{\omega C}{G_{ant}}\right\} - 2\tan^{-1}\left\{\frac{\omega(C/t)}{G_{ant}}\right\} \quad (13)$$

where t is the tunability of the varactor (the ratio of the maximum capacitance to the minimum capacitance). Note that varactors at the ports are not the same, but they have the same tunability, t. A plot of the achievable phase shift, Δθ, versus the normalized capacitive susceptance, $\omega C/G_{ant}$, for various varactor tunabilities is shown in FIG. 16. The graph shows the phase difference between each two adjacent extended resonance ports as a function of the varactor capacitance value at 0 volt bias and its tenability range. This essentially maps out the performance (one desires the max phase shift achievable) as a function of the varactor initial capacitance and its tunability range. The extended resonance phased array design requires equal power division between ports, while achieving max scan range. Therefore there are only a set of design parameters that can be chosen to satisfy these requirements. The plot indicates that depending on the tunability of the varactor, there exists an optimum normalized capacitive susceptance, which results in the maximum phase shift between power divider ports, or maximum scan angle for the phased array. The optimum normalized capacitive susceptance is also found analytically by finding the roots of the derivative of the achievable phase shift, Δθ, with respect to the normalized capacitive susceptances as given below:

$$\frac{d(\Delta\theta)}{d\left(\frac{\omega C}{G_{ant}}\right)} = \frac{2}{1+\left(\frac{\omega C_{opt}}{G_{ant}}\right)^2} - \frac{2t}{(t)^2+\left(\frac{\omega C_{opt}}{G_{ant}}\right)^2} \quad (14)$$

Therefore, the optimum normalized capacitive susceptance is:

$$\frac{\omega C_{opt}}{G_{ant}} = \sqrt{t} \quad (15)$$

The resulting maximum achievable phase shift between power divider ports is therefore:

$$\Delta\theta_{max} = \pi - 2\tan^{-1}\left\{\frac{2\sqrt{t}}{t-1}\right\} \quad (16)$$

Figure 17:
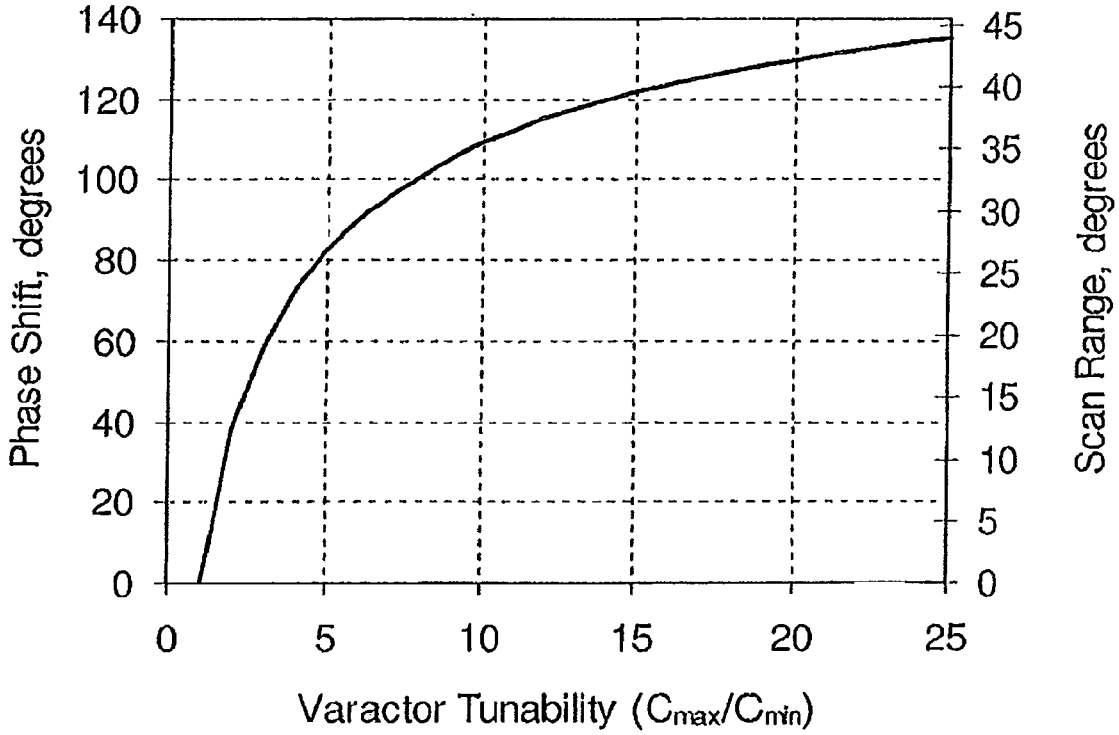
FIG. 17 illustrates the maximum achievable phase shift and scan range versus varactor tunability according to the present invention.

A plot of the maximum achievable phase shift and resulting scan range for a phased array with half wavelength antenna spacing versus the varactor tunability is shown in FIG. 17. The plot allows the designer to determine the varactor tunability based on a desired array scan angle. Varactors are usually fabricated using solid-state, ferroelectric, and MEMS technologies. Solid-state based varactors are well-mature and available in the commercial market, presenting the most economic choice. MEMS and ferroelectric based varactors have potential of providing better performance; however are not mature enough yet. Depending on the technology utilized, varactors are fabricated for continuous or discrete tuning of operation. Examples of varactors with continuous tuning include solid-state varactor diodes or ferroelectric varactors. They can be tuned continuously with the applied voltage and can achieve tunabilities usually in the range 3:1 to 15:1. Varactors with discrete tuning are realized by switching fixed capacitors or transmission lines using p-I-n diodes, FET or MEMS switches, hence they can be designed for very high tunabilities. Therefore, assuming a solid-state varactor tunability of 15:1, approximately 120 degrees of phase shift can be realized from extended resonance based phased arrays, which corresponds to 40 degrees of scan range in a phased array with half wavelength antenna spacing. For switchable length transmission lines, the achievable phase shift approaches 180 degrees, or 60 degrees of scan range in the phased array.

Example 3

Figure 18:
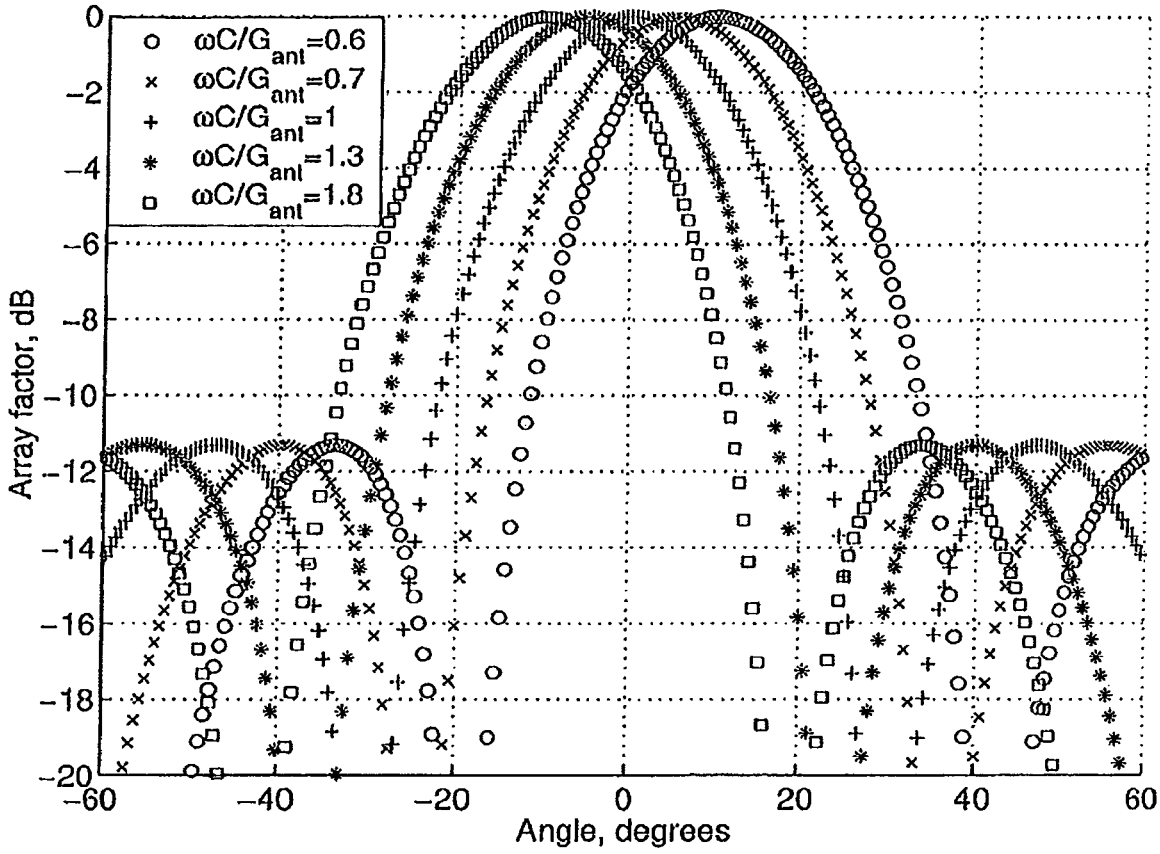
FIG. 18 illustrates a simulated array factor for a 4-antenna extended resonance phased array according to the present invention, where the antennas are $\lambda/2$ apart, varactor tunability is 3.2:1, and the circuit is assumed to be lossless.
Figure 19:
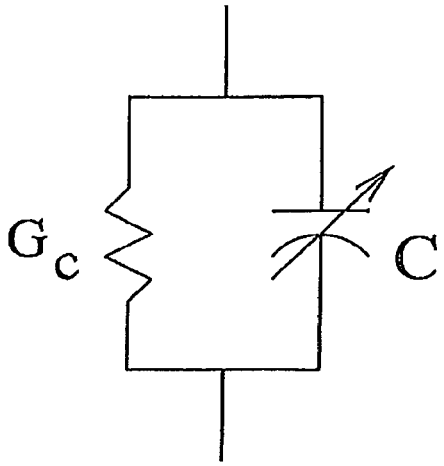
FIG. 19 illustrates the equivalent circuit model for the varactor according to the present invention.

Based on the theory outlined, simulated array factor for a 4-antenna extended resonance phased array for various normalized capacitive susceptances is shown in FIG. 18 (antennas are λ/2 apart). Once again this graph shows the array radiation pattern versus capacitance. In this case instead of the actual varactor capacitance values, the ratio of the varactor suceptance to the antenna radiation conductance is shown. After choosing the frequency of operation and the antenna radiation conductance, the varactor capacitance can be calculated. The simulated scan range is 21 degrees for the varactor tunability of 3.2:1. In this simulation, the varactors and transmission lines were assumed to be lossless. The effect of finite varactor quality factor (Q) on the efficiency of the extended resonance array feed has also been studied. The equivalent circuit model for the varactor is shown in FIG. 19 and its associated quality factor is given in equation (17).

$$Q = \frac{\omega C}{G_c} \quad (17)$$

where C=capacitance of a tunable capacitor, and Gc=shunt conductance of the tunable capacitor that is responsible for the loss in a nonperfect tunable capacitor. Essentially, the nonperfect tunable capacitor is modeled as a shunt combination of a lossless tunable capacitor and a shunt conductance.

Therefore, at the power divider ports, some portion of the divided power is radiated through the antenna with input conductance of $G_{ant}$, and the rest is dissipated within the varactors through their shunt conductances. Assuming all the varactors in the circuit have the same quality factor, the efficiency of the extended resonance phased array feed can be calculated as given in equation (18) by taking the ratio of the total radiated power from the antennas to the sum of the total radiated power and the power lost within the varactors:

$$\text{Efficiency} = \frac{NG_{opt}}{NG_{ant} + 2(N-1)NG_c} \tag{18}$$

where N is the number of antennas (N>1). Equation (18) can be further simplified using (17) as:

$$\text{Efficiency} = \frac{Q}{Q + 2(N-1)\frac{\omega C}{G_{ant}}} \tag{19}$$

Figure 20:
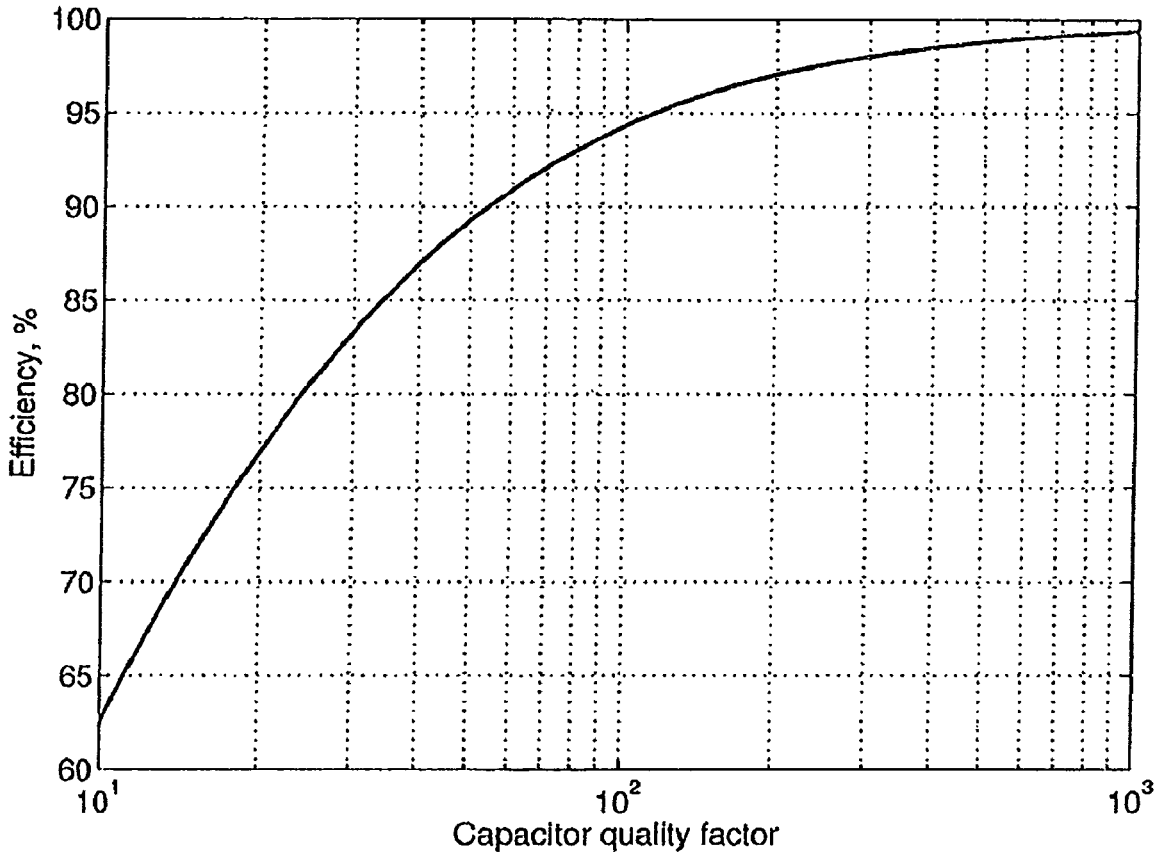
FIG. 20 illustrates a simulated array feed efficiency versus varactor quality factor for N=4 antennas according to the present invention.

A plot of the array efficiency versus varactor quality factor for a 4-antenna element phased array is shown in FIG. 20. The array efficiency is calculated based on the varactor losses used in this particular experiment. Solid state-based varactors usually achieve quality factors in the range of 20 to 150. Therefore, it is possible to realize efficiencies higher than 75% using commercially available solid-state varactors. Much higher efficiency can be achieved using switched transmission lines as tuning elements due to their high quality factors.

Figure 21:
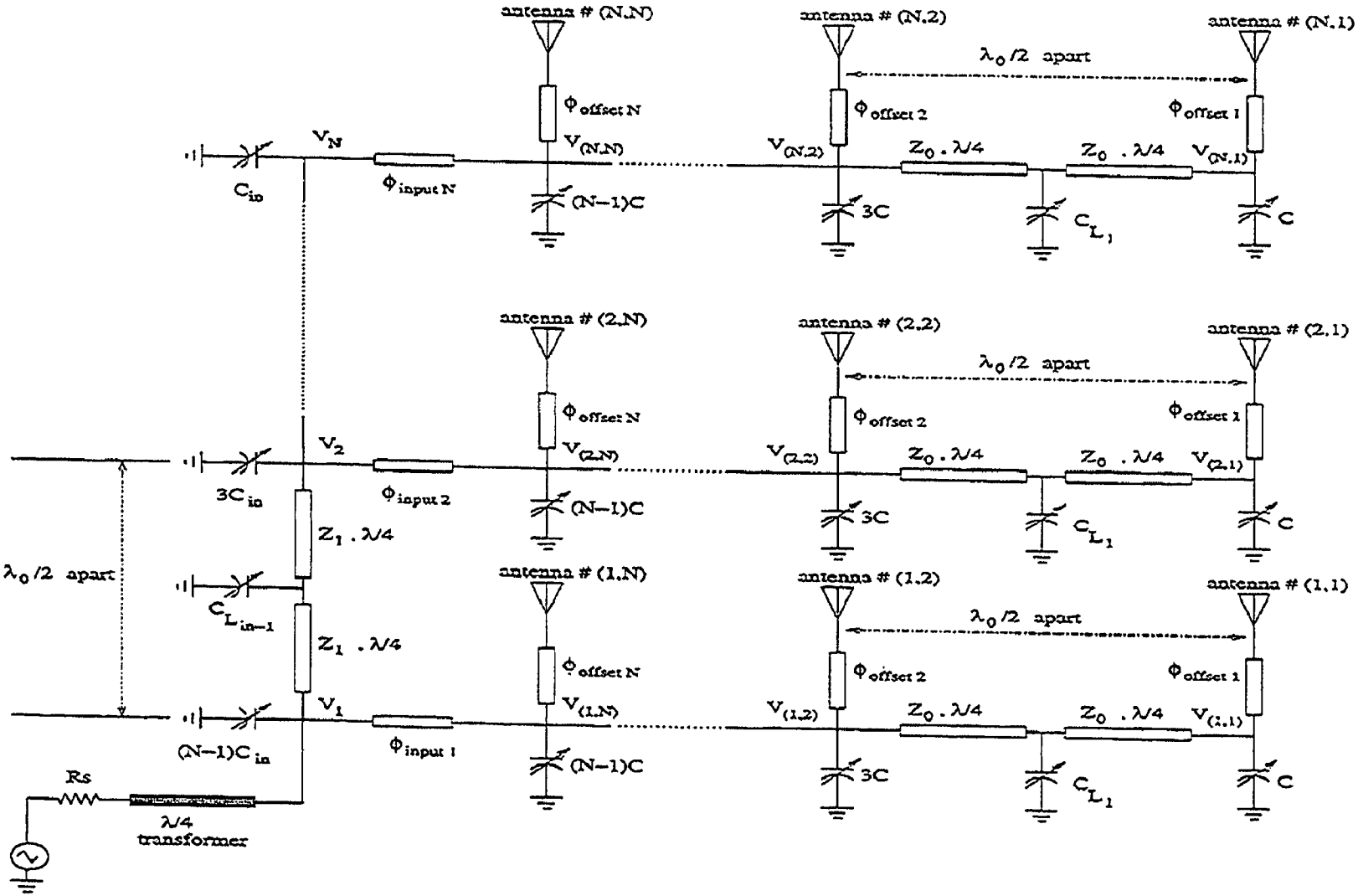
FIG. 21 illustrates an extended resonance phased array for two dimensional scanning according to the present invention.

Extended resonance beam-steering technique can also be used to design phased arrays with two dimensional scanning capability as shown in FIG. 21. Multiple 1-dimensional horizontal scanning arrays, similar to the array shown in FIG. 15, are fed using a vertically scanning extended resonance circuit to achieve 2-dimensional beam-steering capability.

Figure 22:
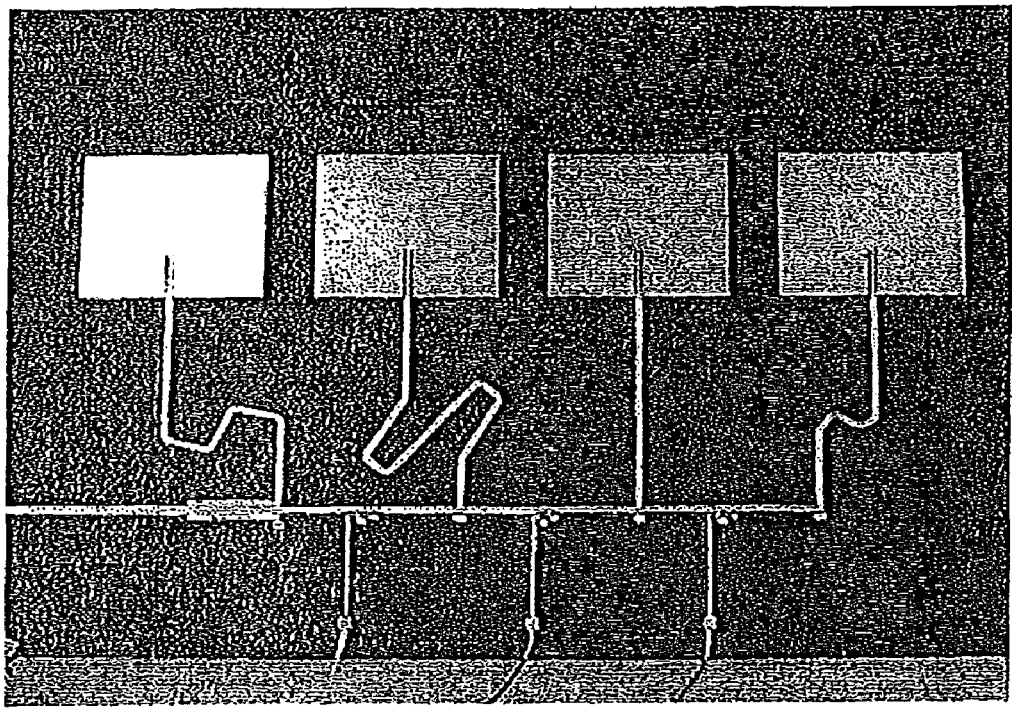
FIG. 22 illustrates a photo of the phased array according to the present invention, where the array dimensions are 15.4×9.8 inch$^2$.
Figure 23:
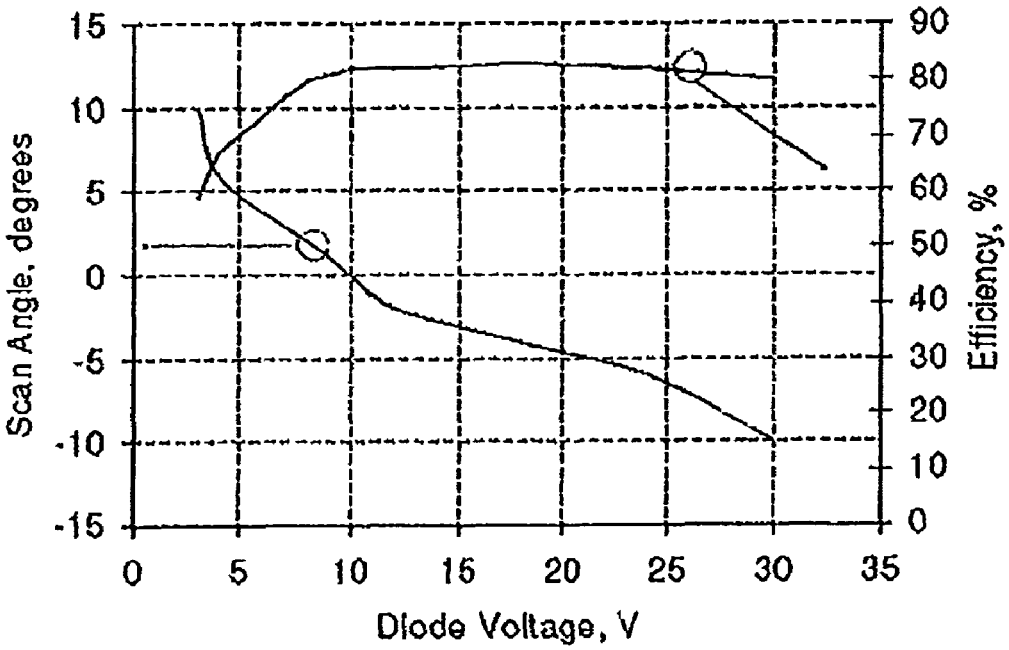
FIG. 23 illustrates a measured scan angle and array feed efficiency versus the diode voltage according to the present invention, where varactor tunability is 3.2:1 from 3 V to 30 V.
Figure 24:
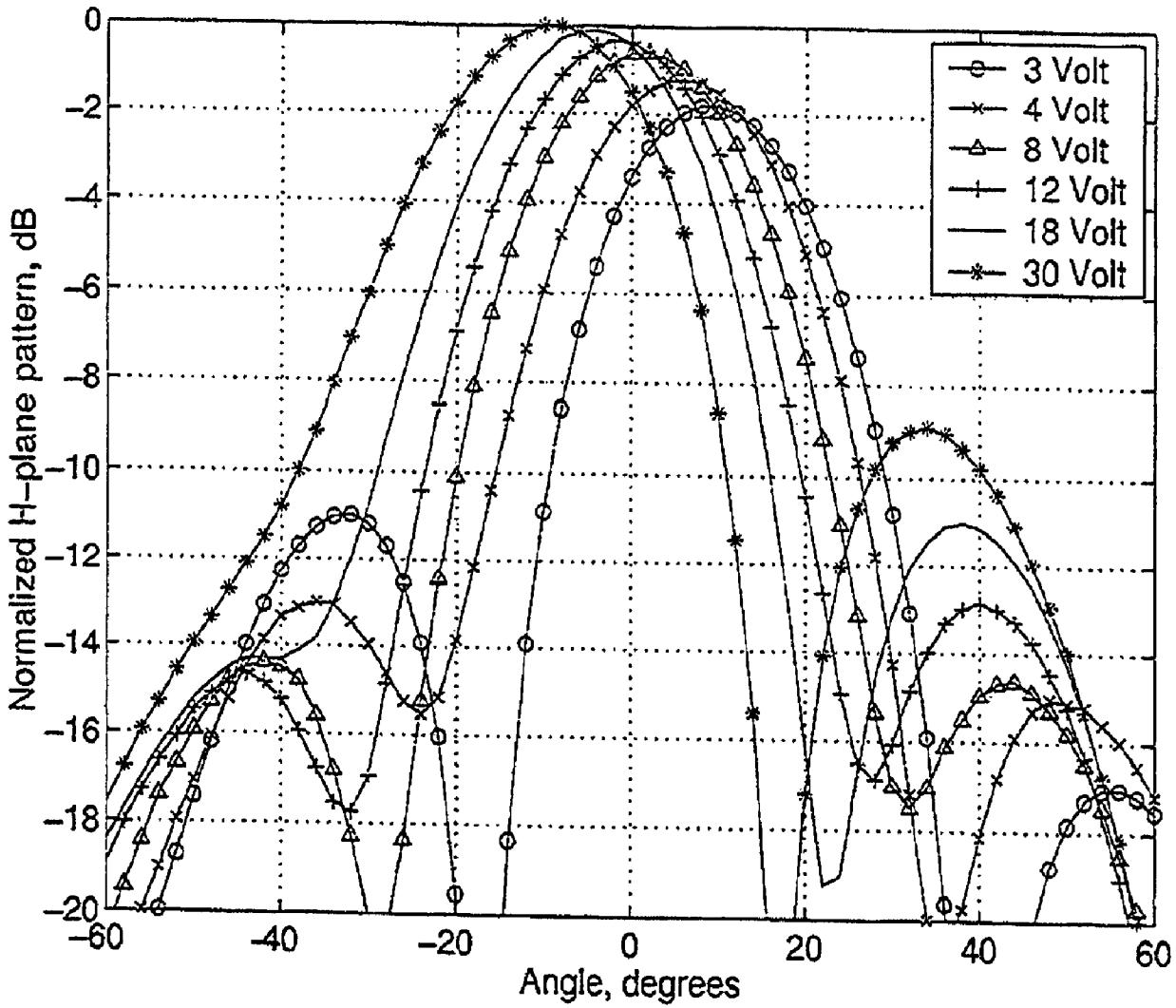
FIG. 24 illustrates a measured H-plane pattern for various diode voltages according to the present invention, where measured gain at 30 V is 8.7 dB.

To demonstrate the utility of this technique, a 2 GHz extended resonance based phased array consisting of four edge coupled microstrip patch antennas placed half wavelength apart was designed, fabricated and tested. A 31 mil thick RT/DUROID™ 5880 high frequency laminate substrate from Rogers Corporation and MSV34 series chip varactor diodes from Metelics Inc. were used to fabricate the phased array. The antenna dimensions were 2.31×1.96 inch$^2$. The input impedance of the antenna was designed as 67Ω by recessing the feed point by 637 mils. The tunability of the varactors was 3.2:1 with the application of 3 V to 30 V reverse bias. A photo of the phased array is shown in FIG. 22. The overall size of the phased array is 15.4×9.8 inch$^2$. The radiation pattern of the phased array has been measured in an anechoic chamber, and the efficiency of its extended resonance feed was determined by measuring the magnitude and phase of the signal at each antenna node using a vector network analyzer. The measured scan angle and array feed efficiency versus the diode voltage is shown in FIG. 23. This shows the plots for the measured efficiency and scan angle as a function of the varactor diode bias voltage for the phased array of FIG. 22. At low bias voltages, varactor diodes become very lossy, therefore the array efficiency decreases at low biases voltages. Measured H-plane patterns of the phased array for various diode voltages are also shown in FIG. 24 and the measured performance is summarized in Table II. As the varactor bias voltage is adjusted, the radiation scans in the azimuth plane. The plot shows how the pattern scans the azimuth as the varactor bias voltage is varied.

TABLE II

THE MEASURED PERFORMANCE OF THE PHASED ARRAY

| Diode Voltage, V | Scan Angle, degrees | 3 dB Beamwidth, degrees | Side Lobe Level, dB | Gain, dB | Efficiency, % |
|---|---|---|---|---|---|
| 3 | 10 | 24 | −91. | 6.9 | 59 |
| 4 | 6 | 24 | −12 | 7.5 | 67 |
| 8 | 2 | 26 | −14 | 8.1 | 80 |
| 10 | 0 | 24 | −13.5 | 8.4 | 82 |

TABLE II-continued

THE MEASURED PERFORMANCE OF THE PHASED ARRAY

| Diode Voltage, V | Scan Angle, degrees | 3 dB Beamwidth, degrees | Side Lobe Level, dB | Gain, dB | Efficiency, % |
|---|---|---|---|---|---|
| 12 | −2 | 24 | −12.5 | 8.4 | 82 |
| 18 | −4 | 26 | −11 | 8.6 | 83 |
| 24 | −6 | 26 | −11 | 8.7 | 82 |
| 30 | −10 | 28 | −9 | 8.7 | 80 |

Figure 25:
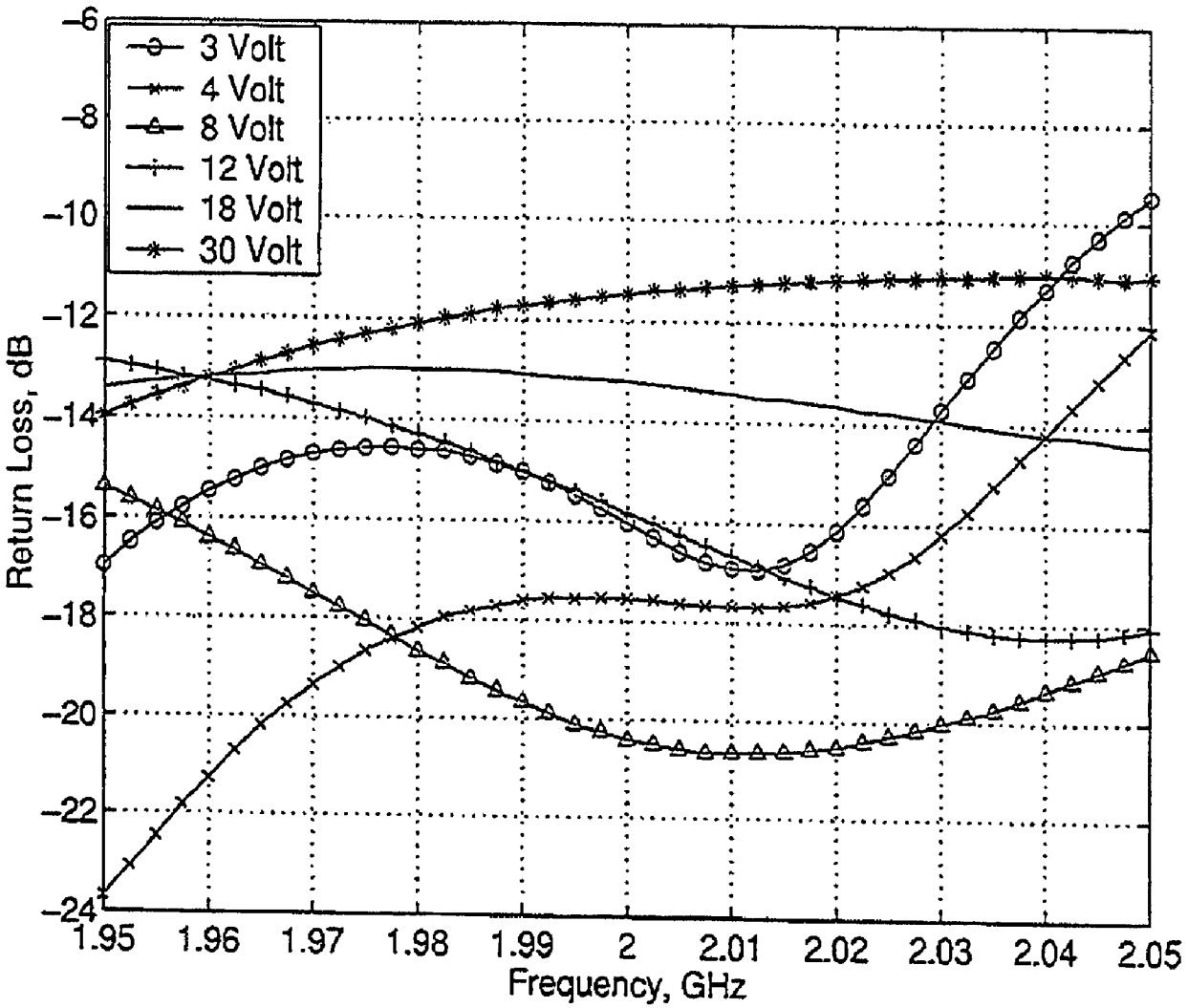
FIG. 25 illustrates a measured return loss for various diode voltages according to the present invention.

The phased array can steer the beam by +/−10 degrees with the application of 3 V to 30 V reverse bias to the varactor diodes, which compares well with the simulated scan range. The measured side lobe level was better than −9 dB and the average 3-dB beam width was 25 degrees. The measured array feed efficiency is typically 80% (corresponds to 1 dB insertion loss). It drops to 59% (2.3 dB insertion loss) as the diode voltage is reduced to 3 V due to the increased loss of the varactors at low reverse bias voltages. It should be noted that other tunable capacitors with lower loss, such as ferroelectric or MEMS based tunable capacitors, switched capacitors or transmission lines using PIN diodes or MEMS switches can be utilized to fabricate the extended resonance phased arrays with better performance. The measured return loss of the phased array was better than 10 dB for all the diode voltages tested as shown in FIG. 25 and cross-polarization was lower than −23 dB. As shown in this graph, the measured input return loss pilots as a function of frequency for the array of FIG. 22. Each return loss plot is given for a specific varactor bias voltage. Through all the bias voltages, the input return loss of the entire phased array remains below 11 dB indicating a very good impedance match for the phased array.

Figure 26:
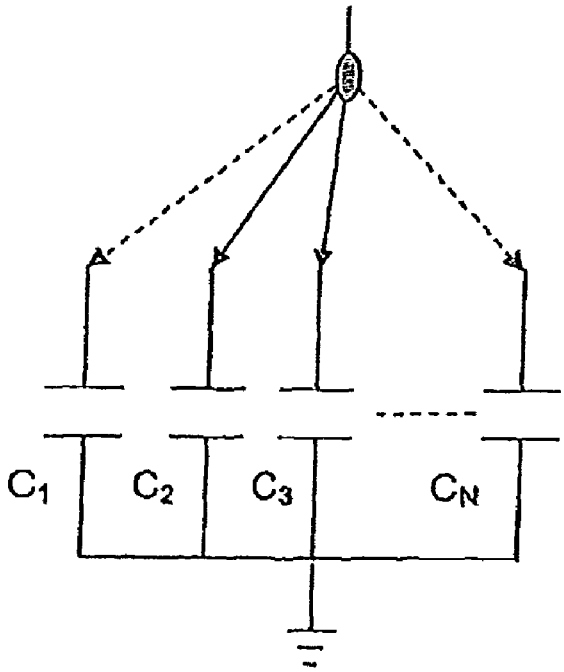
FIG. 26 is a detailed illustration of an embodiment where a second tunable element is a switching fixed capacitor C configuration to be inserted in place of the second tunable element illustrated in any of FIGS. 1-3 or FIGS. 13-15.

FIG. 26 is a detailed illustration of an embodiment where a second tunable element is a switching fixed capacitor $C_1$, $C_s$, $C_3$, $C_n$ configuration to be inserted in place of the second tunable element illustrated in any of FIGS. 1-3 or FIGS. 13-15.

Figure 27:
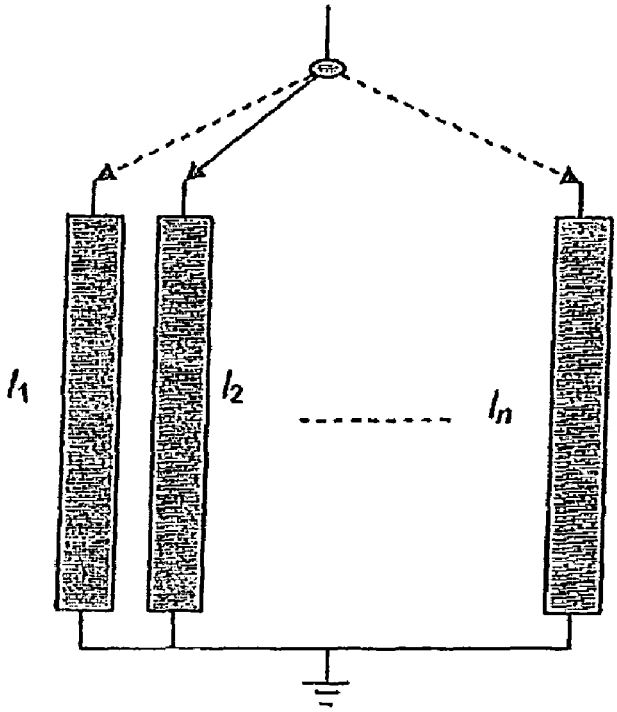
FIG. 27 is a detailed illustration of an embodiment where a second tunable element is a switching transmission line l configuration to be inserted in place of the second tunable element illustrated in any of FIGS. 1-3 or FIGS. 13-15.

FIG. 27 is a detailed illustration of an embodiment where a second tunable element is a switching transmission line $l_1$, $l_2^{-n1} \ldots l_n$ configuration to be inserted in place of the second tunable element illustrated in any of FIGS. 1-3 or FIGS. 13-15.

What is claimed is:

1. A phased array for controlling a radiation pattern comprising:

an extended resonance circuit having an N plurality of ports;

an antenna and a shunt impedance connected to each port;

the extended resonance circuit including a plurality of first tunable series impedances, one of which is connected between each of the N plurality of ports, each first impedance transforming the admittance of one port coupled to the first tunable impedance to the conjugate of the admittance for a serially adjacent second one of the N plurality of ports such that the voltage at each of the ports is the same magnitude across the circuit; and a power source having an impedance matched to the impedance of an endmost port in the array.

2. The phased array of claim 1 wherein each of the plurality of shunt impedances is identical for each port in the array and each of the plurality of first impedances is identical for each port in the array.

3. The phased array of claim 1 wherein each of the first plurality of impedances is a tunable inductor.

4. The phased array of the claim 3 wherein the series impedance between each port is a tunable transmission line, and the shunt impedance is a tunable capacitance.

5. The phased array of claim 1 wherein each of the plurality of first (series)impedances between each port includes two serially connected quarter-wave transformers with a tunable capacitor connected in shunt therebetween.

6. The phased array of claim 1 further comprising:

a single biased voltage to the endmost port in the array.

7. The phased array of claim 1, wherein the phase shift between successive ports is equal.

8. The phased array of claim 1 wherein each of the first impedances is a single series tunable impedance.

9. The phased array of claim 1 wherein each of the shunt impedances connected to each port is a single tunable admittance.

* * * * *